US012616269B2

(12) United States Patent
Wang et al.

(10) Patent No.: US 12,616,269 B2
(45) Date of Patent: May 5, 2026

(54) MULTI-STATION ROTATING HAT IRONING MACHINE FOR HAT MAKING INDUSTRY

(71) Applicants: QINGDAO QIANFENG CAPART INT'L CORP, Qingdao (CN); QINGDAO DUODAI INTELLIGENT TECHNOLOGY CO., LTD., Qingdao (CN)

(72) Inventors: Aimei Wang, Qingdao (CN); Zihao Wu, Qingdao (CN)

(73) Assignees: QINGDAO QIANFENG CAPART INT'L CORP, Qingdao (CN); QINGDAO DUODAI INTELLIGENT TECHNOLOGY CO., LTD., Qingdao (CN)

( * ) Notice: Subject to any disclaimer, the term of this patent is extended or adjusted under 35 U.S.C. 154(b) by 0 days.

(21) Appl. No.: 18/796,071

(22) Filed: Aug. 6, 2024

(65) Prior Publication Data

US 2025/0228326 A1 Jul. 17, 2025

(30) Foreign Application Priority Data

Jan. 16, 2024 (CN) ..... 202410058449.7

(51) Int. Cl.

| | |
|---|---|
| ***A42C 1/08*** | (2006.01) |
| ***D06F 71/18*** | (2006.01) |
| ***D06F 71/34*** | (2006.01) |

(52) U.S. Cl.

CPC ..... *A42C 1/08* (2013.01); *D06F 71/18* (2013.01); *D06F 71/34* (2013.01)

(58) Field of Classification Search

CPC ..... A42C 1/08; D06F 71/18; D06F 71/34

See application file for complete search history.

(56) References Cited

U.S. PATENT DOCUMENTS 1,888,375 A * 11/1932 Diener ..... A42C 1/08 223/51
2,538,579 A * 1/1951 Meaker ..... C14B 5/00 223/7

FOREIGN PATENT DOCUMENTS

CN 209518321 U * 10/2019
CN 209547036 U * 10/2019

(Continued)

OTHER PUBLICATIONS

Translation of CN 111329176.*

(Continued)

*Primary Examiner* — Shaun R Hurley
(74) *Attorney, Agent, or Firm* — Birchwood IP

(57) ABSTRACT

A multi-station rotating hat ironing machine for hat making industry is provided, which includes a rack; a turntable device, where the turntable device is provided on the rack and includes a turntable and a driving assembly provided at a bottom of the turntable; hat ironing devices, where a plurality of hat ironing devices are mounted on the turntable device, the hat ironing devices each includes a hat supporting device and a hat pulling device, a bottom of the hat ironing head is provided with a transverse movement assembly and a longitudinal movement assembly, and the hat pulling device is provided on an outer side of the hat supporting device; and an automatic air blowing device provided with an air blowing nozzle. The rotating hat ironing machine adopts the turntable device to realize cyclic shaping and hat ironing.

10 Claims, 13 Drawing Sheets

(56) References Cited

FOREIGN PATENT DOCUMENTS

| | | | | | |
|---|---|---|---|---|---|
| CN | 111329176 | A | * | 6/2020 | ..... A42C 1/08 |
| CN | 113633060 | A | * | 11/2021 | ..... A42C 1/08 |
| KR | 20040003542 | A | * | 1/2004 | ..... A42C 1/08 |

OTHER PUBLICATIONS

Translation of KR 20040003542.*
Translation of CN 113633060.*
Translation of CN 209547036.*
Translation of CN 209518321.*

* cited by examiner

MULTI-STATION ROTATING HAT IRONING MACHINE FOR HAT MAKING INDUSTRY

CROSS-REFERENCE TO RELATED APPLICATIONS

This application claims priority to Chinese Patent Application No. 202410058449.7, filed on Jan. 16, 2024, which is hereby incorporated by reference in its entirety.

TECHNICAL FIELD

The present invention relates to the field of production of hats, in particular to a multi-station rotating hat ironing machine.

BACKGROUND

A hat ironing process is an important step in a hat production process. Hat production is achieved by thirty percent of seaming and seventy percent of ironing. After hat seaming is completed, surfaces of the hats are wrinkled, and only after being ironed and shaped by a hat ironing machine, the hats can be shaped and have beautiful appearances.

At present, when hats are ironed, the hats are placed on the hat ironing machine, and the hats are taken down after being ironed and cooled. With an urgent need for automatic production of hats, there is an urgent need of realizing automatic ironing. However, existing hat ironing devices cannot realize automatic hat ironing and have low processing efficiency. An apparatus capable of realizing automatic hat ironing is required urgently.

SUMMARY

In order to solve the problems of the prior art, the present invention provides a multi-station rotating hat ironing machine for the hat making industry, comprising: a rack; a turntable device, wherein the turntable device is provided on the rack and comprises a turntable and a driving assembly that is provided at a bottom of the turntable; hat ironing devices, wherein a plurality of hat ironing devices are mounted on the turntable device, the hat ironing devices each comprise a hat supporting device and a hat pulling device, the hat supporting device has a hat ironing head that can be divided into four parts, a bottom of the hat ironing head is provided with a transverse movement assembly for transversely separating and moving the left and right parts and a longitudinal movement assembly for separating the front and rear parts of the hat ironing head, and the hat pulling device is provided on an outer side of the hat supporting device; and an automatic air blowing device, wherein the automatic air blowing device is provided with an air blowing nozzle.

Specifically, one side of the rack is provided with a front hat pulling device, and the front hat pulling device comprises a front hat pulling device fixing frame, a sliding movement assembly that is hoisted in the front hat pulling device fixing frame and a front hat pulling head that is mounted at a bottom of the sliding movement assembly.

Specifically, the sliding movement assembly comprises first cylinders for longitudinally moving the front hat pulling head to an equal height of the hat ironing head, a third cylinder for pressing the front hat pulling head to a front of a hat and a second cylinder for pulling the hat downward, the front hat pulling device fixing frame is provided with two first linear guide rails, first sliding blocks are mounted in the first linear guide rails, a transplanting plate is fixedly connected to the two first sliding blocks, the first cylinders are provided on the front hat pulling device fixing frame, piston rods of the first cylinders are fixedly connected to the transplanting plate, the second cylinder is mounted on the transplanting plate, and a piston rod of the second cylinder is connected to a cylinder body of the third cylinder.

Specifically, the hat pulling device is mounted at the bottom of the turntable and comprises a plurality of pressing mechanisms and a downward pulling mechanism that is provided at bottoms of the pressing mechanisms.

Specifically, the downward pulling mechanism comprises a vertical moving plate on which the plurality of pressing mechanisms are mounted and a fifth cylinder, and a piston of the fifth cylinder is fixedly connected to a bottom of the vertical moving plate; and the pressing mechanisms each comprise a fixed column, a first rocker arm fixing plate and a second rocker arm fixing plate are fixedly mounted on two sides of the fixed column, an end portion of a cylinder body of a sixth cylinder is connected to the first rocker arm fixing plate through a cylinder fixing shaft, upper ends of the first rocker arm fixing plate and the second rocker arm fixing plate are provided with a deep groove ball bearing, one end of a rocker arm is rotatably connected in the deep groove ball bearing, a piston rod of the sixth cylinder is connected to a second joint bearing, the second joint bearing is rotatably connected to a T-shaped clamp, the T-shaped clamp is fixedly mounted on a side wall of the rocker arm, a connection position of the T-shaped clamp tilts upward, an upper end of the rocker arm is provided with an adjustment rod, and an end portion of the adjustment rod is provided with a hat pulling head.

Specifically, the longitudinal movement assembly is mounted on a hat supporting device fixing bottom plate and comprises a seventh cylinder, second linear guide rails and second sliding blocks that are provided in the second linear guide rails, and a piston rod of the seventh cylinder is connected to longitudinal moving plate fixing seats; the transverse movement assembly is provided on the longitudinal movement assembly and comprises a longitudinal moving plate that is mounted on the longitudinal moving plate fixing seats and the second sliding blocks, a slide rail fixing frame is provided above a cylinder body of the seventh cylinder, third linear guide rails are provided in the longitudinal moving plate and the slide rail fixing frame, third sliding blocks are provided in the slide rail fixing frame, and a piston rod of an eighth cylinder is connected to the third sliding blocks; and tops of the third sliding blocks are fixedly connected to a transverse movable plate.

Specifically, a front end of the piston rod of the seventh cylinder is provided with a first hydraulic buffer, and a buffer end of the first hydraulic buffer is in contact with a side wall of the longitudinal moving plate; and a second hydraulic buffer is provided above the eighth cylinder, and a buffer end of the second hydraulic buffer is in contact with a positioning block that is connected to a side wall of the transverse movable plate.

Specifically, the rack is designed in two layers, the upper layer of the rack is provided with a circular through hole, a plurality of wave bead buffers are provided at equal intervals around the circular through hole, and wave beads in the wave bead buffers are in contact with a bottom surface of the turntable device; and the lower layer of the rack is provided with a servo motor fixing seat and a cam splitter fixing frame.

Specifically, the driving assembly comprises a servo motor that is mounted on the servo motor fixing seat and a cam splitter that is mounted in the cam splitter fixing frame, an output shaft of the servo motor is provided with a driving synchronous pulley, an input shaft of the cam splitter is provided with a driven synchronous pulley, and the driving synchronous pulley is connected to the driven synchronous pulley through a synchronous belt.

Specifically, the automatic air blowing device is fixedly mounted in the center of the cam splitter and provided toward a feeding end and comprises an air blowing device fixing frame, a fourth cylinder and the air blowing nozzle, the fourth cylinder is provided on a top of the air blowing device fixing frame, and the air blowing nozzle is connected to a piston rod of the fourth cylinder.

Beneficial effects of the present invention are as follows.

1. According to the rotating hat ironing machine, the hat pulling device and the front hat pulling device fix a hat to be ironed on the hat ironing head and tightly press the hat downward to realize automatic shaping and fixing of the hat, and the hat can be in full contact with the hat ironing head.

2. The hat supporting device can be divided into four parts to support the hat and heat the hat separately, an ironing temperature is uniform, and an ironing effect is good.

3. The rotating hat ironing machine adopts the turntable device to realize cyclic shaping and hat ironing, thereby shortening the waiting time in a hat ironing process, significantly improving working efficiency, reducing labor intensity and reducing the enterprise cost. Moreover, the hat can be subjected to heat preservation for a period of time after ironing, so as to achieve a better hat ironing effect.

DETAILED DESCRIPTION OF THE EMBODIMENTS

Figure 1:
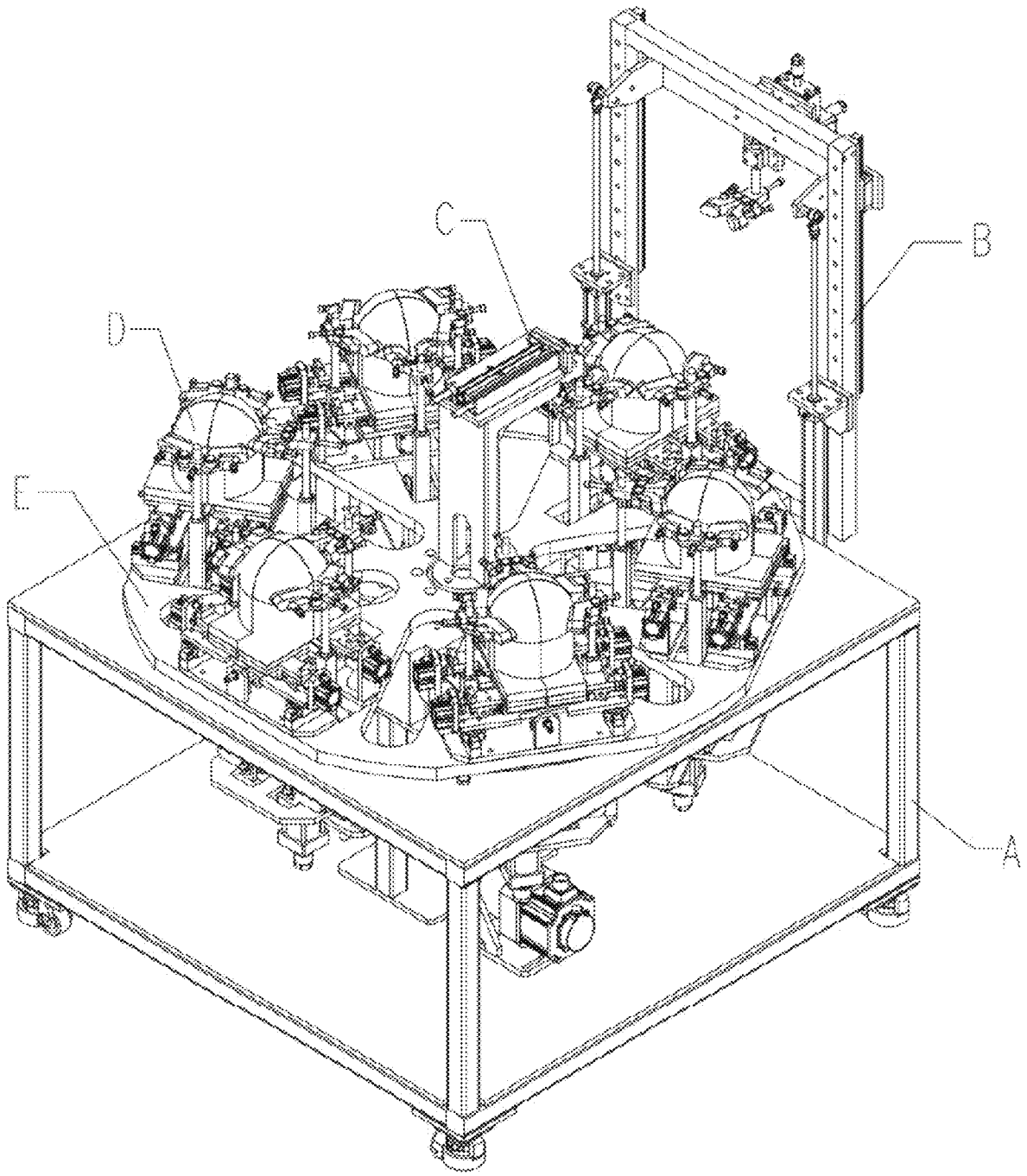
FIG. 1 is an overall three-dimensional structural diagram of the present invention.
Figure 2:
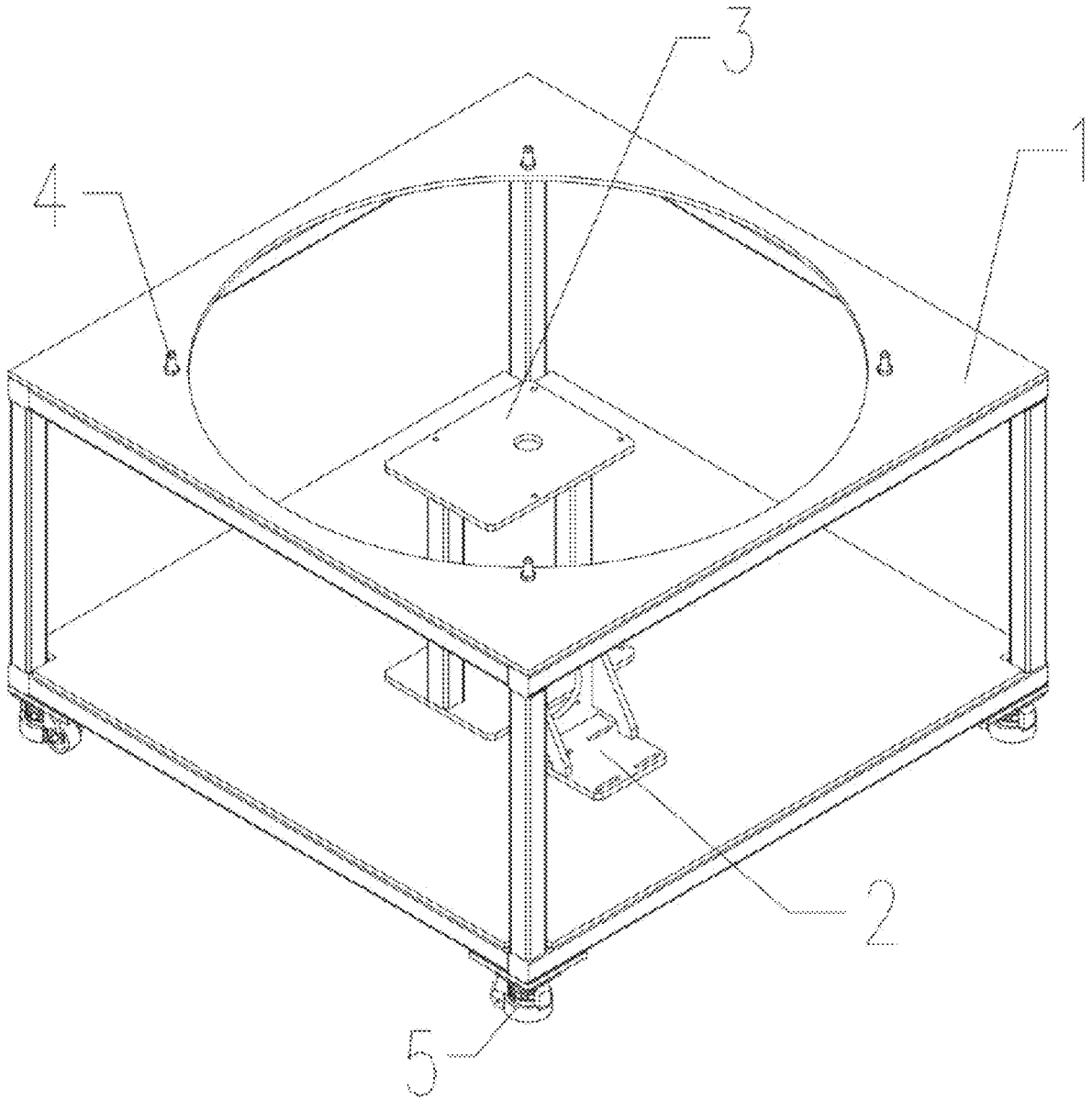
FIG. 2 is a structural diagram of a rack in the present invention.
Figure 3:
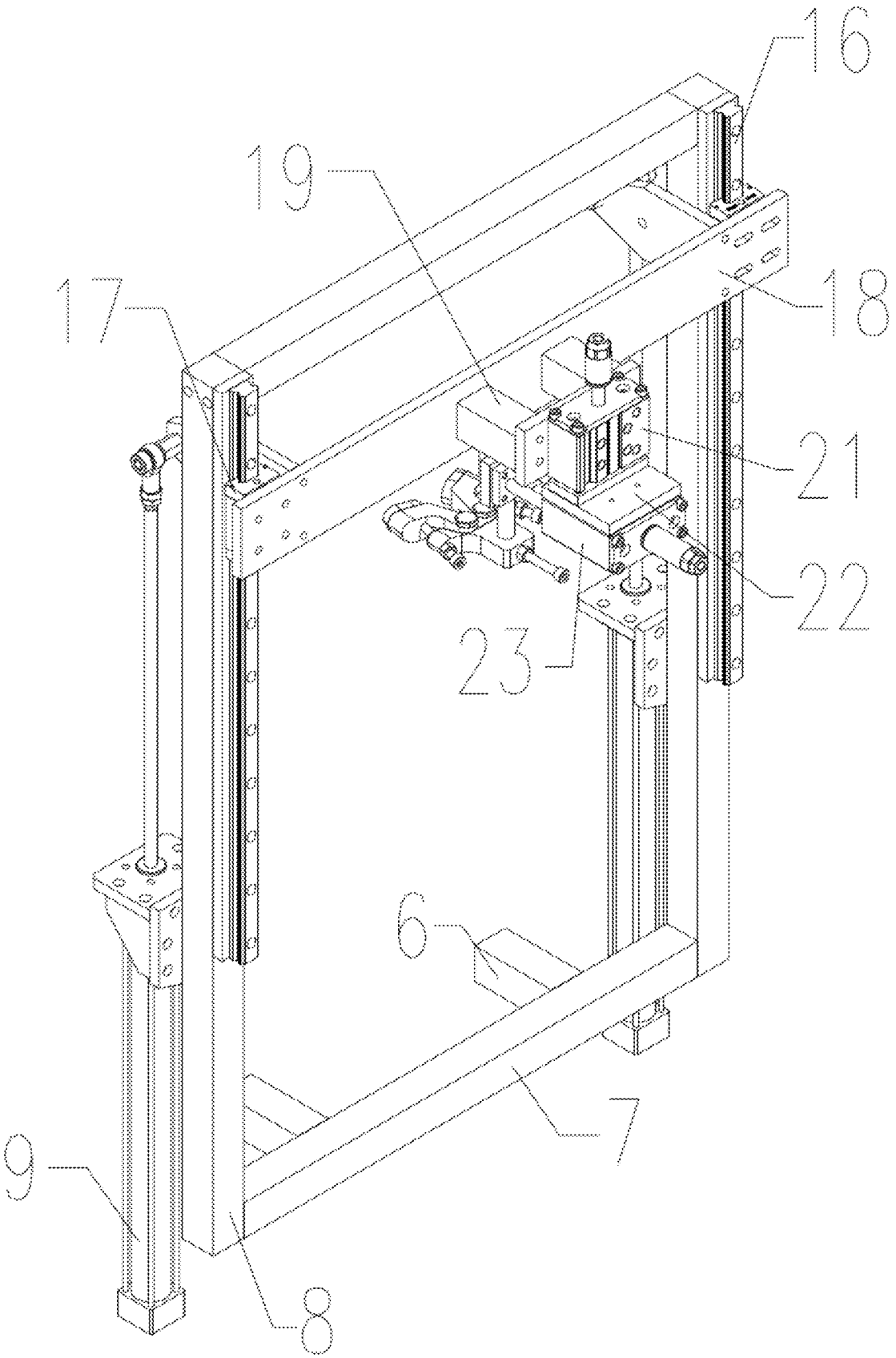
FIG. 3 is a first three-dimensional structural diagram of a front hat pulling device in the present invention.
Figure 4:
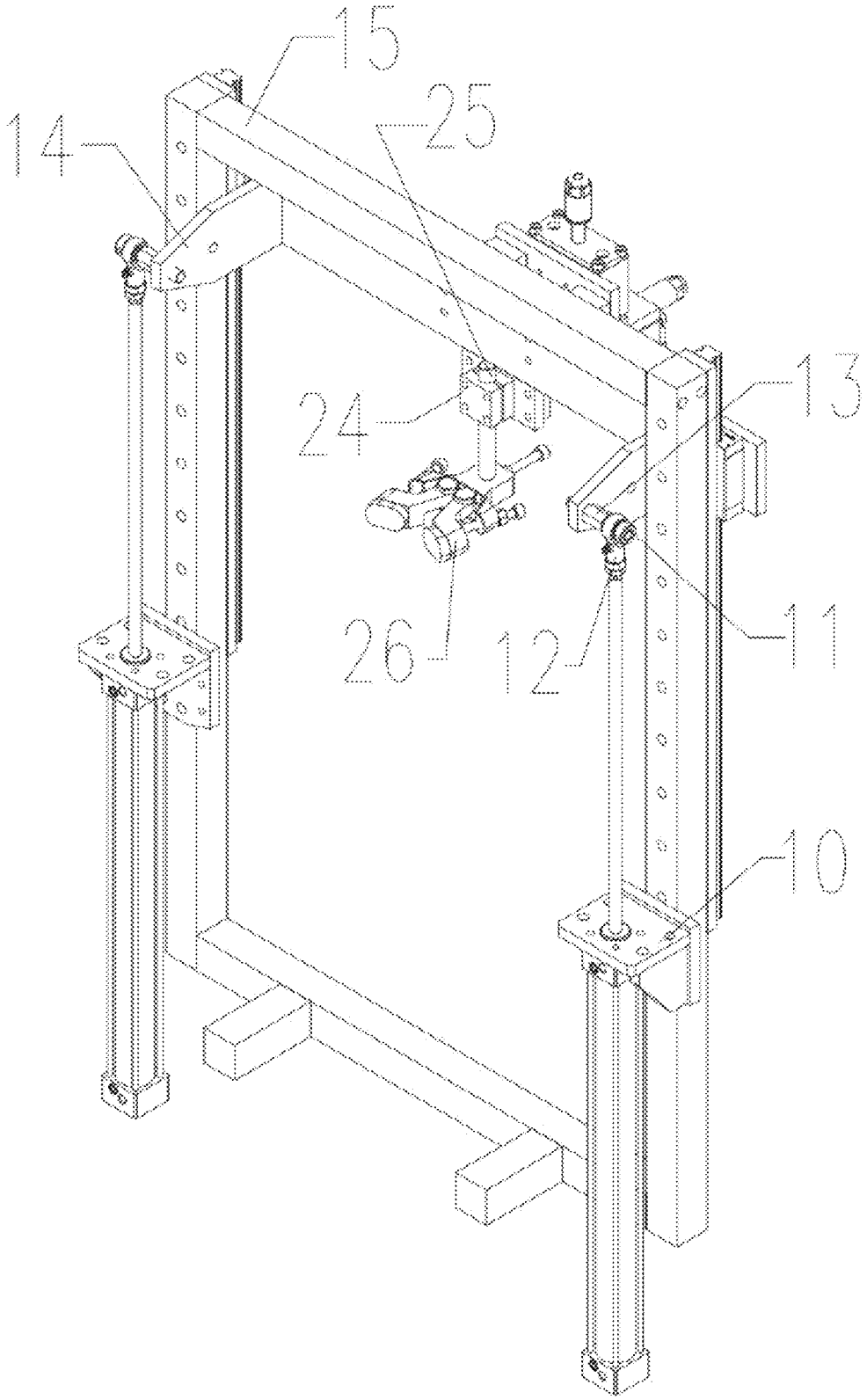
FIG. 4 is a second three-dimensional structural diagram of the front hat pulling device in the present invention.
Figure 5:
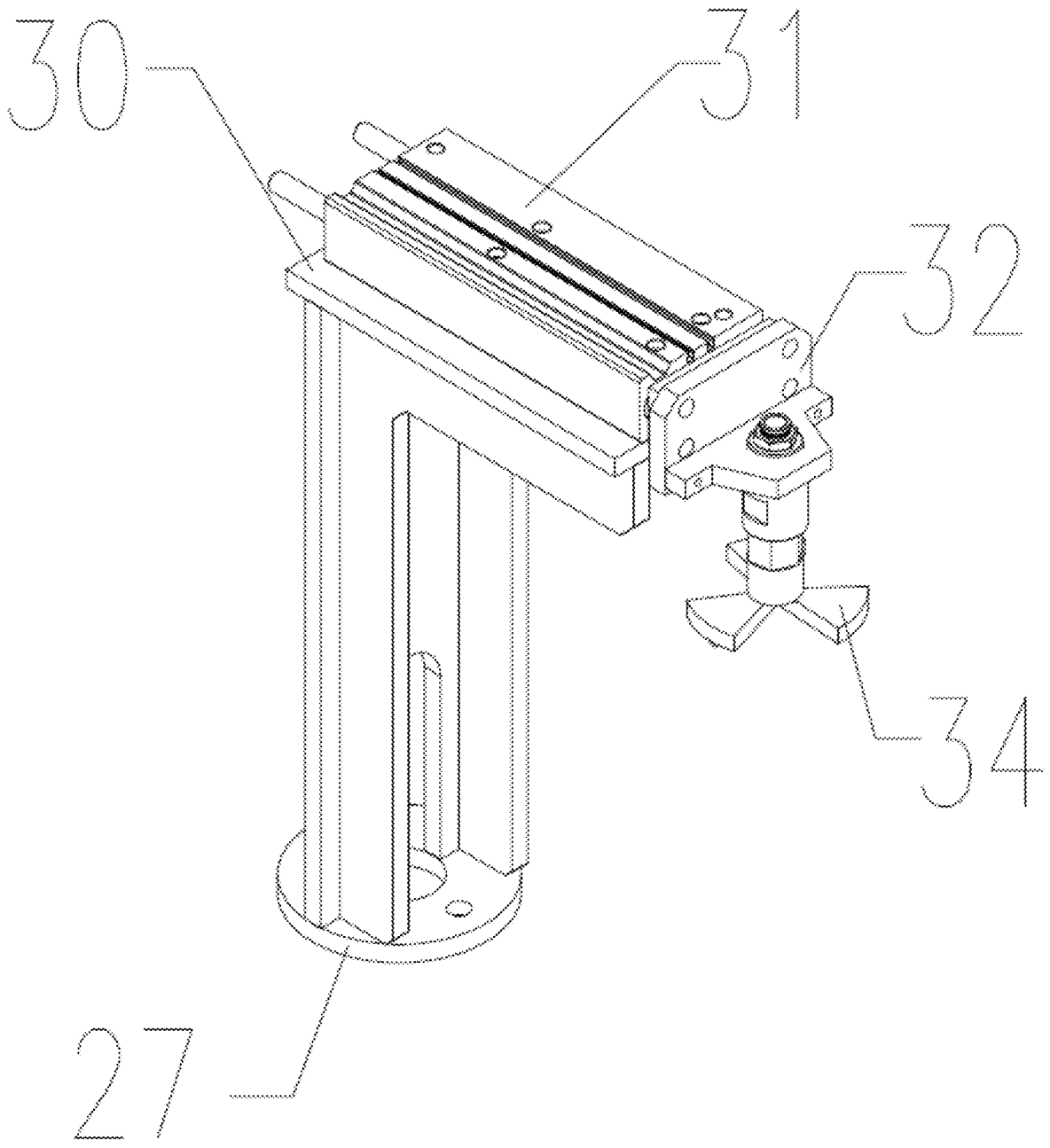
FIG. 5 is a three-dimensional structural diagram of an automatic air blowing device in the present invention.
Figure 6:
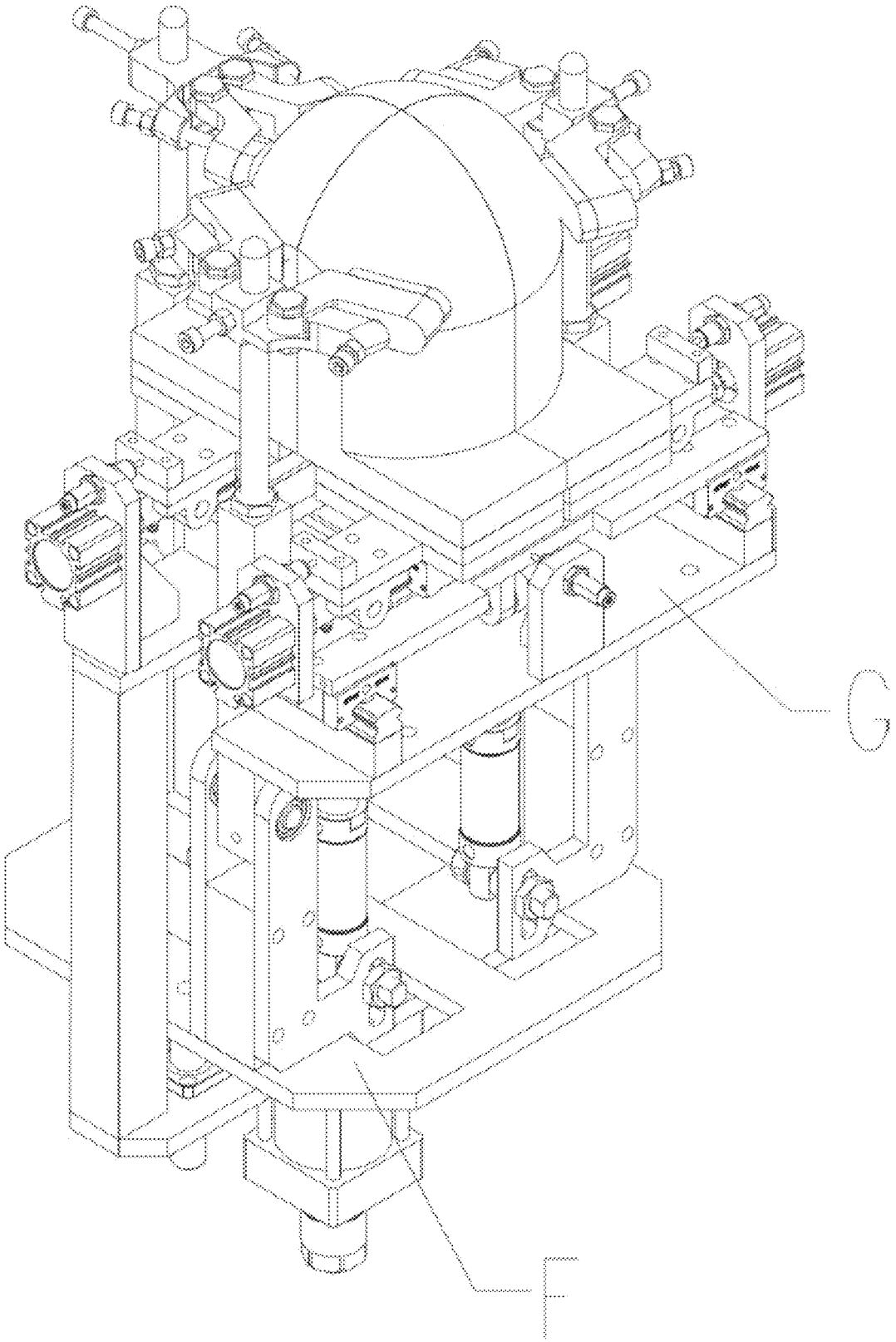
FIG. 6 is an overall three-dimensional structural diagram of a hat ironing device in the present invention.
Figure 7:
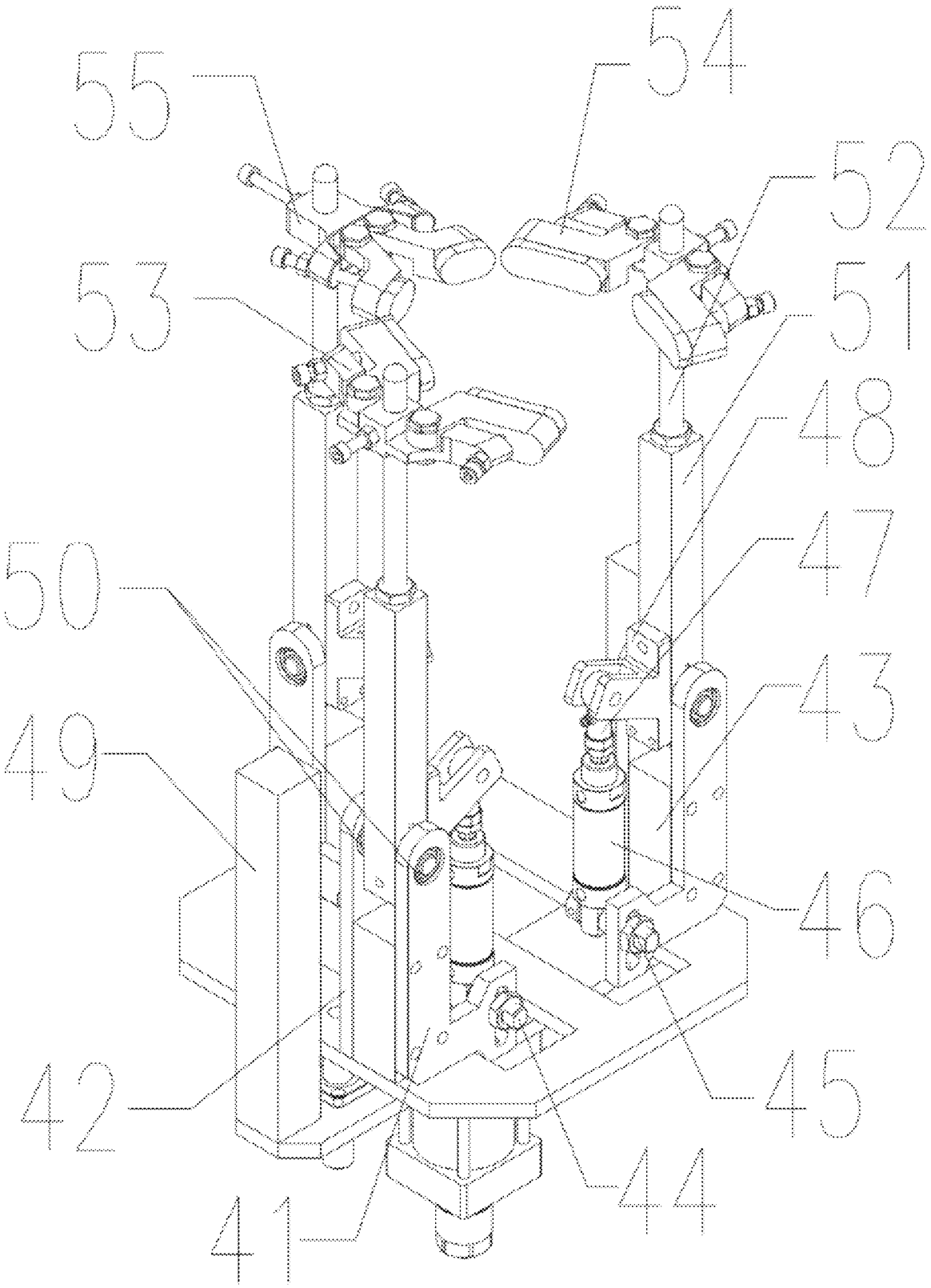
FIG. 7 is a first three-dimensional structural diagram of a hat pulling device in the present invention.
Figure 8:
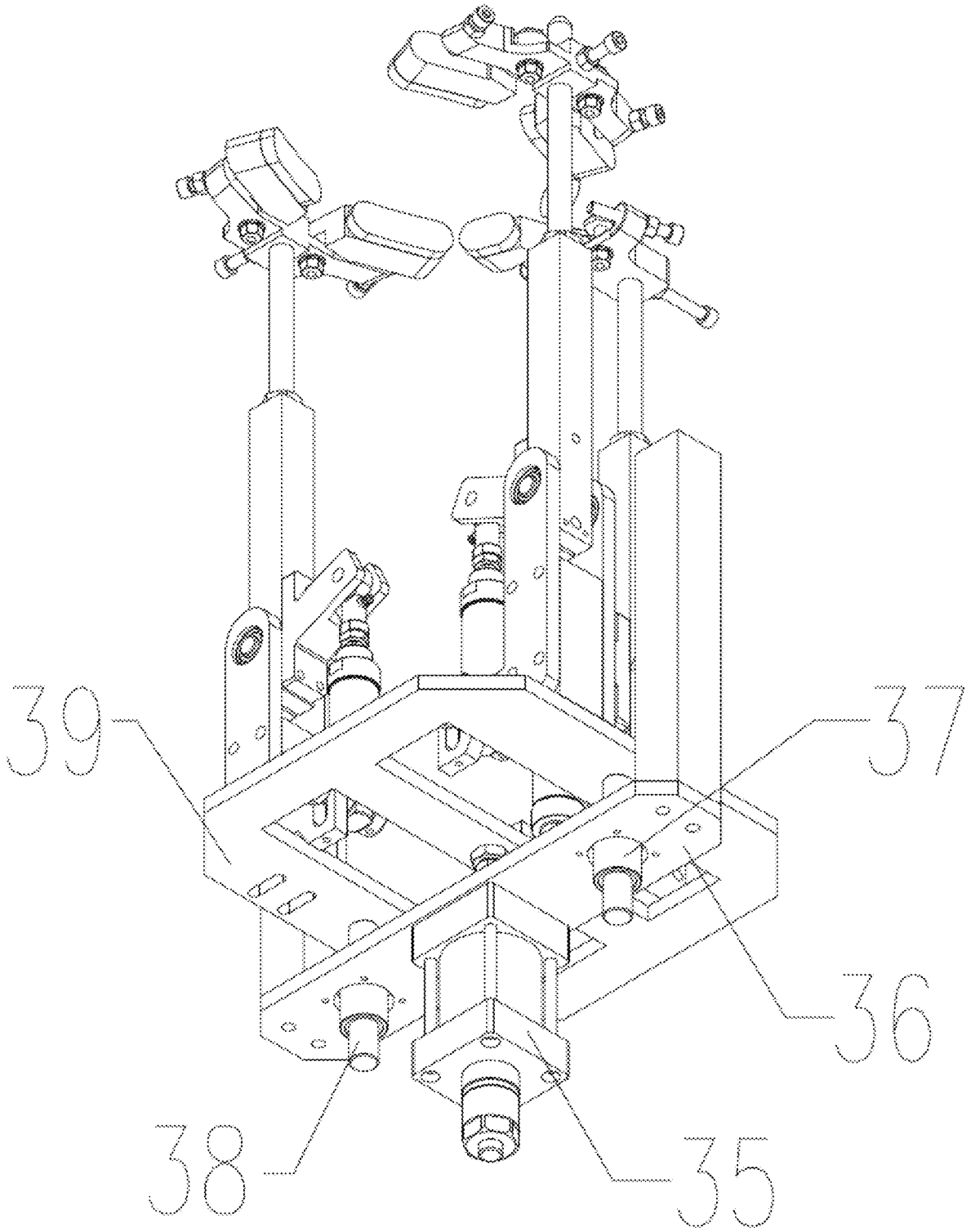
FIG. 8 is a second three-dimensional structural diagram of the hat pulling device in the present invention.
Figure 9:
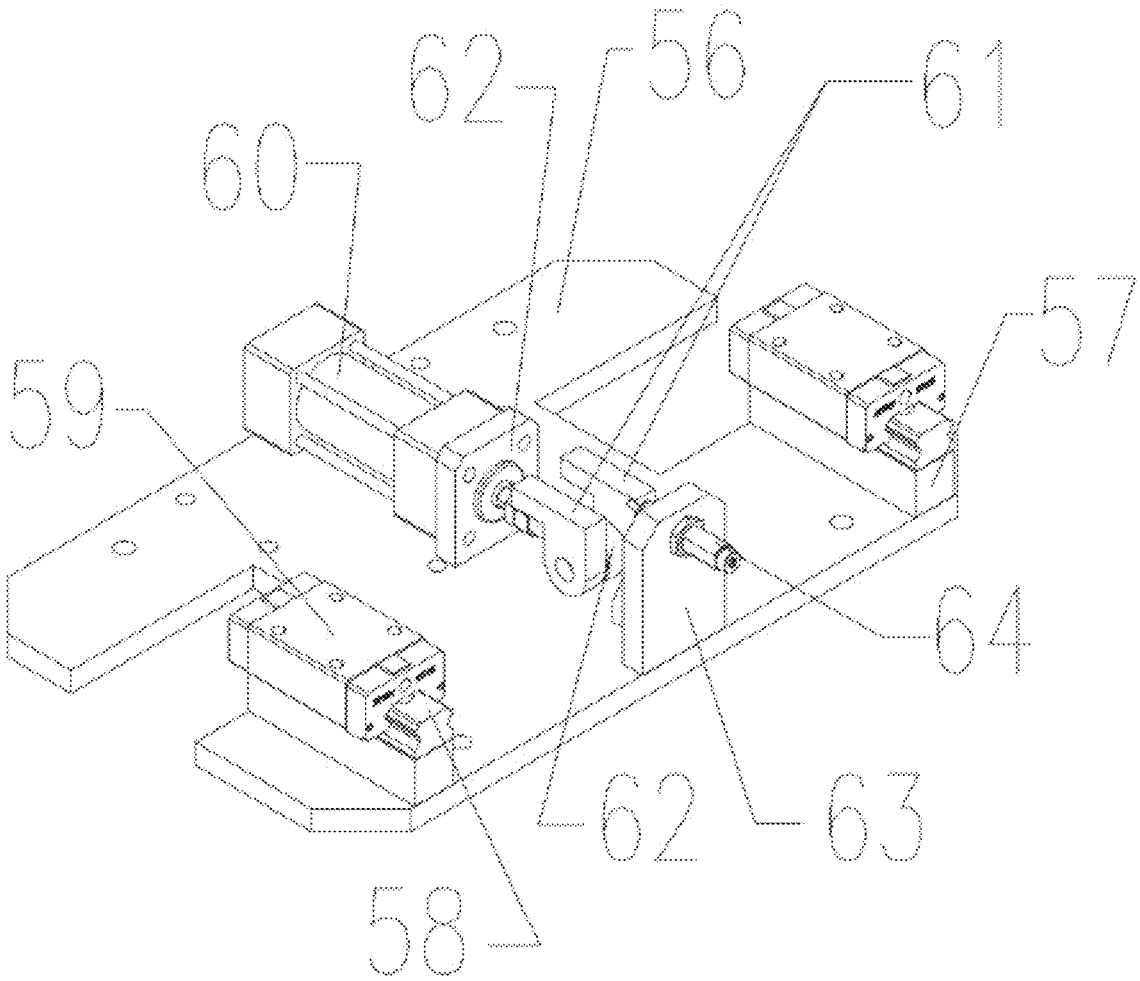
FIG. 9 is a three-dimensional structural diagram of a first portion of a hat supporting device in the present invention.
Figure 10:
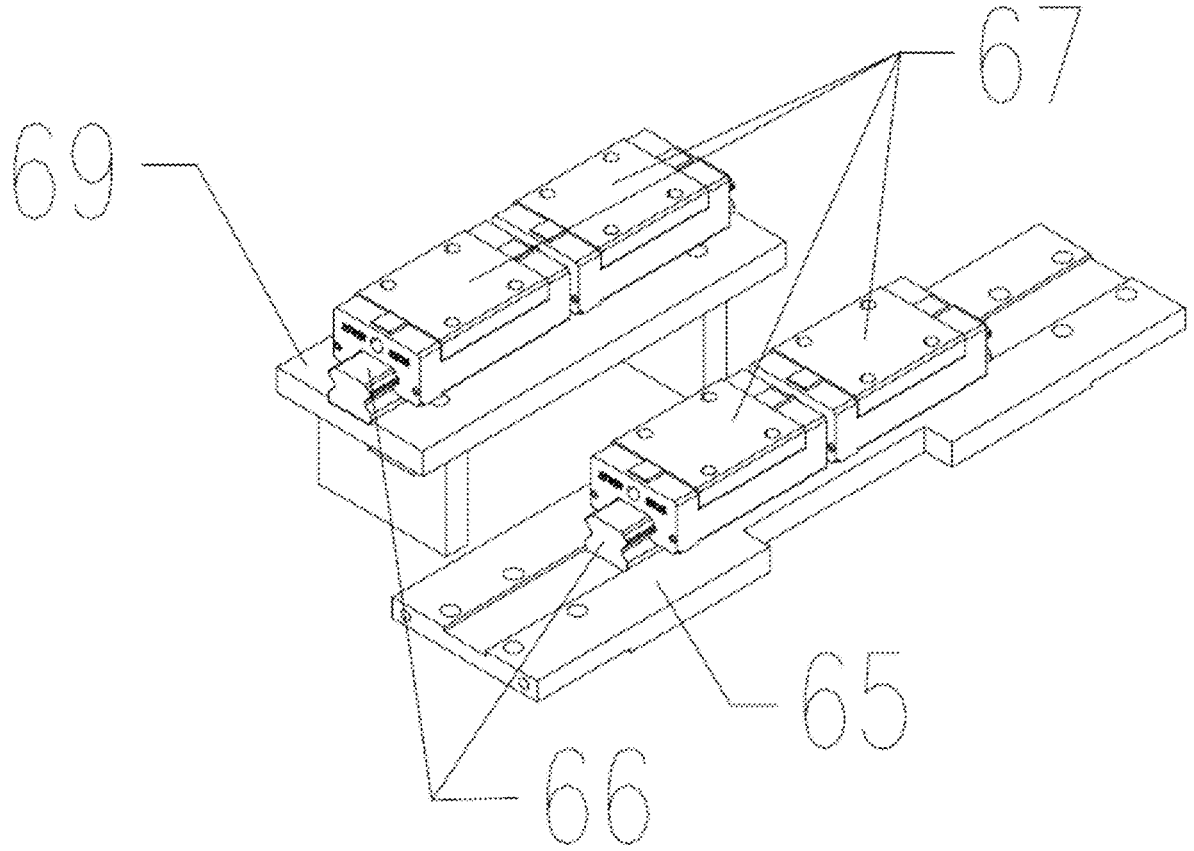
FIG. 10 is a three-dimensional structural diagram of a second portion of the hat supporting device in the present invention.
Figure 11:
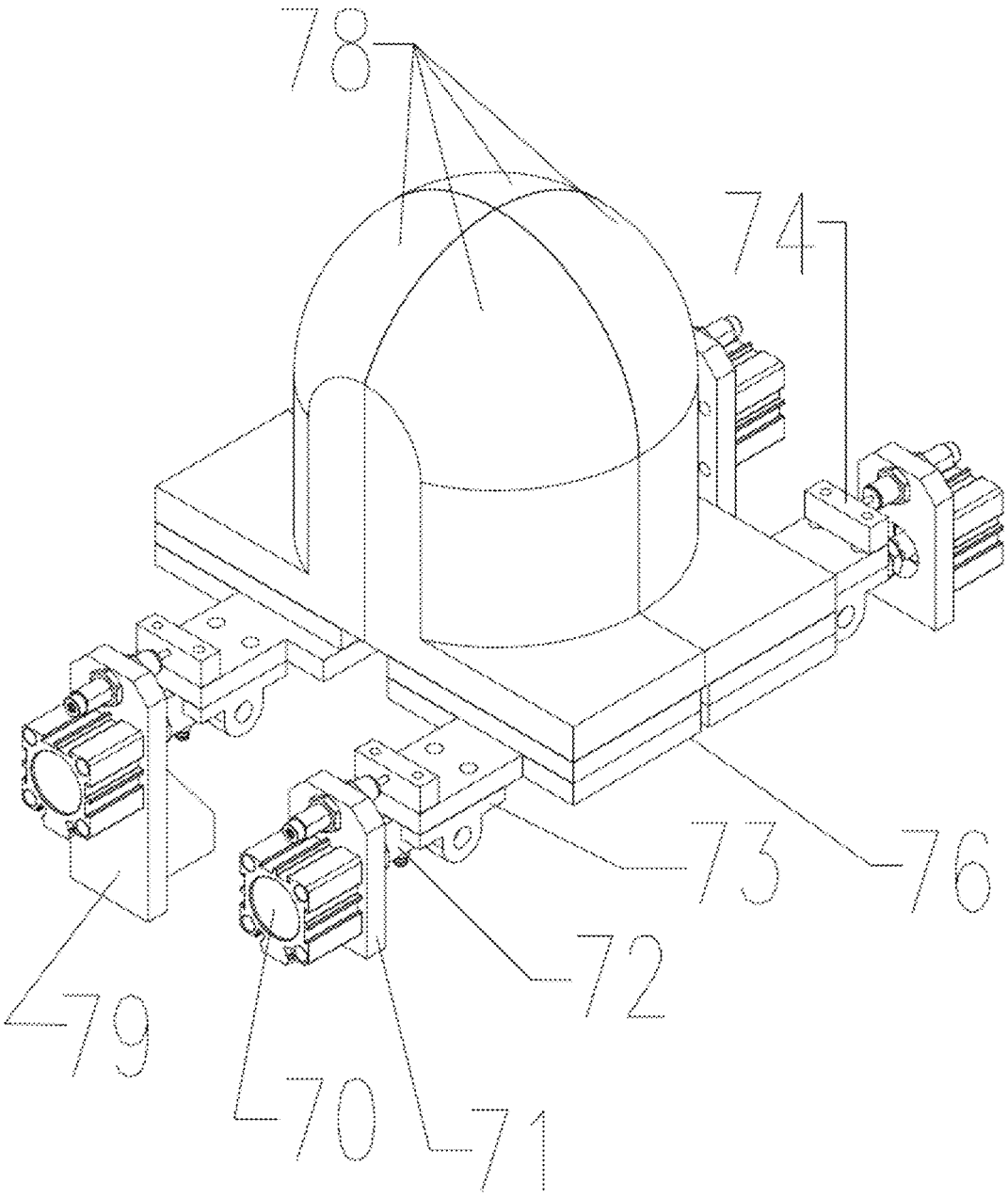
FIG. 11 is a three-dimensional structural diagram of a third portion of the hat supporting device in the present invention.
Figure 12:
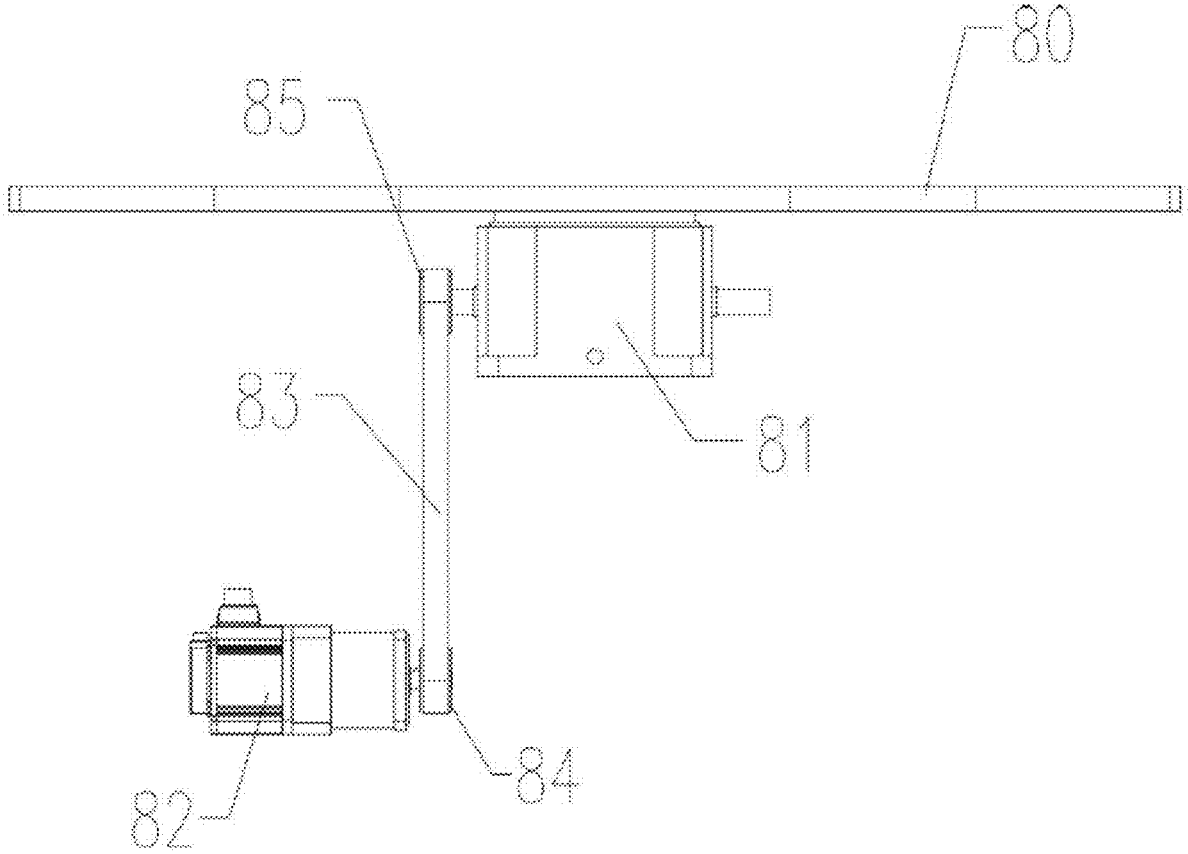
FIG. 12 is a front view of a turntable device in the present invention.
Figure 13:
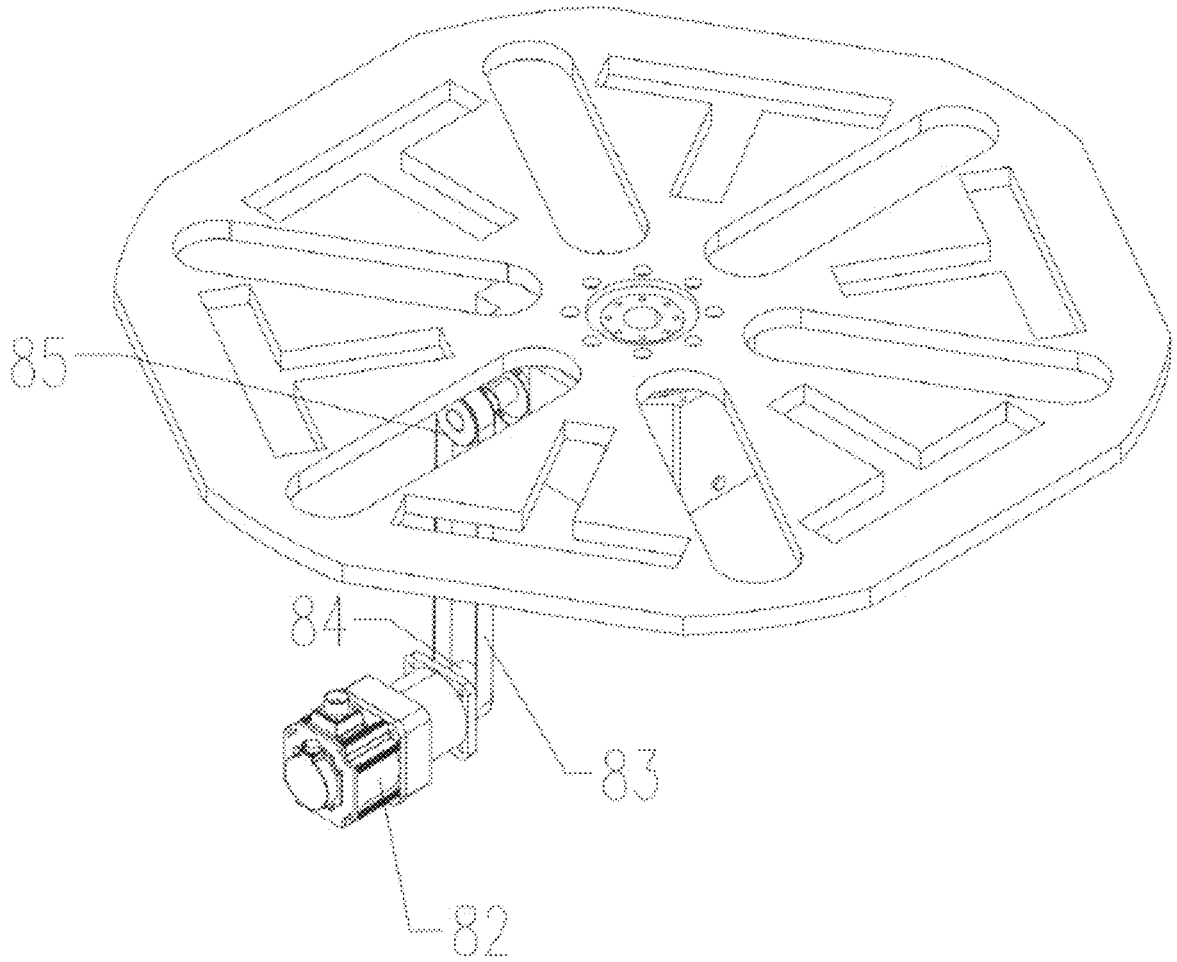
FIG. 13 is a three-dimensional structural diagram of the turntable device in the present invention.

Technical solutions in embodiments of the present invention are clearly and completely described below in conjunction with the accompanying drawings in the embodiments of the present invention. Obviously, the described embodiments are only a part of the embodiments of the present invention, rather than all of the embodiments. On the basis of the embodiments of the present invention, all other embodiments obtained by persons of ordinary skill in the art without exerting creative efforts should fall within the scope of protection of the present invention.

It should be noted that, in the description of the present invention, orientation or position relationships indicated by terms, such as "up", "down", "top", "bottom", "front", "rear", "left", "right", "inside" and "outside", are based on orientation or position relationships shown in the accompanying drawings and are only to facilitate the description, rather than to indicate or imply that a device or a component needs to have a specific orientation or be constructed and operated in a specific orientation, and therefore should not be understood as limitations of the present invention. In addition, it should also be noted that, terms, such as "first" and "second", are only used to describe a purpose and shall not be understood as indicating or implying relative importance.

In addition, it should also be noted that, in the description of the present invention, unless otherwise clearly specified and limited, the terms "provide", "connect" and "connection" should be understood in a broad sense, for example, the "connection" may be detachable connection or integral connection, may be direct connection, and may also be indirect connection through an intermediate component. For persons skilled in the art, the above terms may be understood to have specific meanings in the present invention according to specific circumstances.

A multi-station rotating hat ironing machine for the hat making industry comprises: a rack A, a turntable device E that is provided on the rack A, a plurality of hat ironing devices D that are provided on a turntable 80, an automatic air blowing device C that is provided on the rack A, and a front hat pulling device B that is provided on one side of a feeding end of the turntable 80. The multi-station rotating hat ironing machine realizes cyclic ironing of hats that are placed on the hat ironing devices D, solves the situation of dependence on manual hat ironing in the industry, greatly improves working efficiency, reduces labor intensity and reduces the enterprise labor cost.

The rack A comprises a rack body 1, the rack body 1 is designed in two layers, the lower layer of the rack body 1 is provided with a servo motor fixing seat 2 and a cam splitter fixing frame 3, the upper layer of the rack A is provided with a circular through hole, a plurality of wave bead buffers 4 are provided at equal intervals around the circular through hole, the wave bead buffers 4 each comprise a shell having a hemispherical groove and a wave bead that is provided in the shell, and the wave bead partially extends from the shell and can rotate freely. Four end corners of a bottom of the rack A are provided with floor casters 5 to facilitate movement of the rack A.

The upper layer of the rack body 1 is provided with the turntable device E, the turntable device E comprises the turntable 80 and a driving assembly for driving the turntable 80 to rotate, and the driving assembly comprises a servo motor 82 and a cam splitter 81. The servo motor 82 and the cam splitter 81 are mounted in the servo motor fixing seat 2 and the cam splitter fixing frame 3 respectively, an output shaft of the servo motor 82 is provided with a driving synchronous pulley 84, an input shaft of the cam splitter 81 is provided with a driven synchronous pulley 85, and the driving synchronous pulley 84 is connected to the driven synchronous pulley 85 through a synchronous belt 83. An output end of the cam splitter 81 is fixedly connected to the center of the turntable 80, the servo motor 82 drives the cam splitter 81 to rotate under transmission of the synchronous belt 83, and the cam splitter 81 drives the turntable 80 to rotate. The output end of the cam splitter 81 is higher than an upper surface of the upper layer of the rack body 1, a certain gap is present between the turntable 80 and the upper layer of the rack body 1, the wave beads are in contact with a bottom surface of the turntable device E to support the bottom surface of the turntable device E, and when the turntable 80 rotates, the wave beads of the wave bead buffers 4 roll without increasing the friction. The turntable 80 is provided with a T-shaped through hole, and the hat ironing devices D are fixedly mounted above the T-shaped through hole. In order to reduce the weight of the turntable 80, a strip-shaped through hole is also provided on each of the hat ironing devices D to facilitate rotation of the turntable 80.

The plurality of hat ironing devices D are fixedly provided on the turntable 80. In the present invention, preferably, 6 hat ironing devices D are provided. The hat ironing devices D each comprise a hat pulling device F and a hat supporting device G, wherein the hat supporting device G is fixedly provided above the T-shaped through hole of the turntable 80, the hat pulling device F is connected to the bottom surface of the turntable 80 through a hat pulling device fixing column 49, and the hat pulling device F partially passes through the T-shaped through hole of the turntable 80 and the circular through hole of the rack body 1 and is placed in the rack body 1.

The hat pulling device F is provided on an outer side of the hat supporting device G to fix a hat that is placed on a hat ironing head 78. The hat pulling device F can be provided with two pressing mechanisms for fixing and pressing a left rear portion and a right rear portion of the hat, and can also be provided with three or more pressing mechanisms. As a preferred embodiment of the present invention, 3 pressing mechanisms are provided outside the hat supporting device G, namely a left pressing mechanism, a right pressing mechanism and a rear pressing mechanism. The left pressing mechanism, the right pressing mechanism and the rear pressing mechanism pass through the T-shaped hole and are provided at three end portions of the T-shaped hole respectively. The left pressing mechanism, the right pressing mechanism and the rear pressing mechanism are provided with a left hat pulling head 53, a right hat pulling head 54 and a rear hat pulling head 55 respectively. The left pressing mechanism, the right pressing mechanism and the rear pressing mechanism have a same structure, and the structure of the hat pulling device F is described below with the left pressing mechanism as an example.

The left pressing mechanism is mounted on a vertical moving plate 39, the vertical moving plate 39 is provided with a fixed column 43, a first rocker arm fixing plate 41 and a second rocker arm fixing plate 42 are fixedly mounted on two sides of the fixed column 43, the first rocker arm fixing plate 41 is L-shaped, the second rocker arm fixed plate 42 is linear, one end of the first rocker arm fixing plate 41 that is close to the vertical moving plate 39 is provided with a vertical strip-shaped through hole, an end portion of a cylinder body of a six cylinder 46 is connected to the first rocker arm fixing plate 41 through a cylinder fixing shaft 44, the cylinder fixing shaft 44 passes through the strip-shaped through hole and is fixed by a fixing nut 45, and the strip-shaped through hole is convenient for adjusting the height of the sixth cylinder 46. Upper ends of the first rocker arm fixing plate 41 and the second rocker arm fixing plate 42 are provided with a deep groove ball bearing 50, and one end of a rocker arm 51 is rotatably connected in the deep groove ball bearing 50. A piston rod of the sixth cylinder 46 is connected to a second joint bearing 47, the second joint bearing 47 is rotatably connected to a T-shaped clamp 48, the T-shaped clamp 48 is fixedly mounted on a side wall of the rocker arm 51, a connection position of the T-shaped clamp 48 tilts upward, and the piston rod of the sixth cylinder 46 more easily drives the rocker arm 51 to swing inward and outward. An upper end of the rocker arm 51 is provided with an adjustment rod 52, an end portion of the adjustment rod 52 is provided with a left hat pulling head 53, and the adjustment rod 52 can adjust the height of the hat pulling head to improve the applicability of the hat pulling device F. One side of the hat pulling head that is in contact with the hat is provided with a silicone contact surface to realize flexible contact with the hat and to avoid damage to a surface of the hat.

Bottoms of the pressing mechanisms are provided with a downward pulling mechanism for pulling and fixing the hat pressed on the hat ironing head. A hat pulling device fixing plate 36 is provided below the vertical moving plate 39, two sides of the hat pulling device fixing plate 36 are provided with hat pulling device F fixing shafts, and other ends of the hat pulling device F fixing shafts are fixedly connected to the bottom surface of the turntable 80 to make the hat pulling device F fixedly connected to the turntable 80. A bottom of the hat pulling device fixing plate 36 is provided with a fifth cylinder 35, the fifth cylinder 35 is located in the middle of the hat pulling device fixing plate 36, a piston rod of the fifth cylinder 35 is fixedly connected to a bottom surface of the vertical moving plate 39, two sides of the fifth cylinder 35 are provided with linear bearings 37 respectively, a positioning shaft 38 is located in the linear bearings 37, and the positioning shaft 38 is fixedly connected to the vertical moving plate 39 and guides the vertical moving plate 39 to ascend and descend.

When the hat is removed from or placed on the hat ironing device D, the fifth cylinder 35 pushes the vertical moving plate 39 upward, and the sixth cylinder 46 pushes the T-shaped clamp 48 upward to drive the rocker arm 51 to open to the outer side, such that the hat pulling head moves upward and opens to the outer side, and the hat is convenient to remove or place. After a hat piece is placed on the hat ironing device D, the sixth cylinder 46 pulls the T-shaped clamp 48 downward to drive the rocker arm 51 to contract inward, and the fifth cylinder 35 pulls the vertical moving plate 39 downward, such that the hat pulling head moves downward to press the hat and shape the hat, and the hat is in full contact with the hat ironing head 78 to facilitate shaping of the hat.

The hat supporting device G is fixedly mounted on the turntable 80 and comprises the hat ironing head 78, a transverse movement assembly and a longitudinal movement assembly, the hat ironing head 78 is hemispherical, the hat is placed on the hat ironing head 78 for ironing, the hat ironing head 78 is a detachable design that can be divided into 4 parts from the center, the transverse movement assembly and the longitudinal movement assembly are provided at a bottom of the hat ironing head 78, the transverse movement assembly is used for transversely separating and moving the left and right parts, the longitudinal movement assembly is used for separating the front and rear parts of the hat ironing head 78 to support the hat, and the four parts of the hat ironing head 78 heat the hat separately for ironing. A bottom of the hat supporting device G is provided with a hat supporting device fixing bottom plate 56, the longitudinal movement assembly is mounted on the hat supporting device fixing bottom plate 56 and comprises a seventh cylinder 60 fixing seat, a seventh cylinder 60 is fixedly connected to the seventh cylinder 60 fixing seat, a piston rod of the seventh cylinder 60 passes through the seventh cylinder 60 fixing seat, an end portion of the piston rod is provided with a third joint bearing 62, and longitudinal moving plate fixing seats 61 are mounted on two sides of the third joint bearing 62. Two sides of the hat supporting device fixing bottom plate 56 are provided with two second linear guide rail fixing seats 57, second linear guide rails 58 are fixedly mounted on the second linear guide rail fixing seats 57, and second sliding blocks 59 are mounted in the second linear guide rails 58 and can slide along the second linear guide rails 58. The transverse movement assembly is provided on the longitudinal movement assembly and comprises a longitudinal moving plate 65, the longitudinal moving plate 65 is mounted on the longitudinal moving plate fixing seats 61 and the second sliding blocks 59, and expansion and contraction movement of the piston rod of the seventh cylinder 60 drives movement of the longitudinal moving plate 65. On an edge of the hat supporting device fixing bottom plate 56, a front end of the piston rod of the seventh cylinder 60 is provided with a first hydraulic buffer fixing plate 63, a first hydraulic buffer 64 is mounted in the first hydraulic buffer fixing plate 63, and a buffer end of the first hydraulic buffer 64 is in contact with a side wall of the longitudinal moving plate 65. The piston rod of the seventh cylinder 60 extends to drive the longitudinal moving plate to move forward, the longitudinal moving plate moves forward along the second linear guide rails 58 to divide the hat ironing head 78 into the front and rear parts, and the first hydraulic buffer 64 buffers the movement of the longitudinal moving plate 65 to avoid damage caused to the hat when the piston rod of the seventh cylinder 60 extends too fast.

A slide rail fixing frame 69 is provided above a cylinder body of the seventh cylinder 60, the slide rail fixing frame 69 is provided in parallel and flush with the longitudinal moving plate 65, third linear guide rails 66 are provided on the slide rail fixing frame 69 and the longitudinal moving plate 65, and two third sliding blocks 67 are provided on each of the third linear guide rails 66. Two sides of the longitudinal moving plate 65 are provided with eighth cylinder first fixing plates 71, two sides of the slide rail fixing frame 69 are provided with eighth cylinder second fixing plates 79, an eighth cylinder 70 is provided between the eighth cylinder first fixing plates 71 and the eight cylinder second fixing plates 79, a piston rod of the eighth cylinder 70 is provided toward the third sliding blocks 67, the piston rod of the eighth cylinder 70 is provided with a fourth joint bearing 72, and two sides of the fourth joint bearing 72 are provided with positioning block fixing seats 73. A transverse movable plate 76 is mounted on the third sliding blocks 67, the hat ironing head 78 is fixedly provided above the transverse movable plate 76, and combination and separation of the hat ironing head 78 are realized through expansion and contraction of the seventh cylinder 60 and the eighth cylinder 70. A second hydraulic buffer is provided above the eighth cylinder 70, the second hydraulic buffer is provided in a transverse cylinder fixing plate, a positioning block fixing seat 73 is fixedly provided with a positioning block 74, the positioning block 74 is connected to a side wall of the transverse movable plate 76, and a buffer end of the second hydraulic buffer is in contact with the positioning block 74. The eighth cylinder 70 pulls the third sliding blocks 67 to move along the linear slide rails to divide the hat ironing head 78 into the left and right parts, and when the transverse movable plate moves, the second hydraulic buffer buffers the movement of the transverse movable plate to avoid damage caused to the hat when the piston rod of the cylinder extends too fast.

When the hat supporting device G is used, the hat is placed on the hat ironing head 78, the piston rod of the seventh cylinder 60 extends to separate the two front parts of the hat ironing head 78 forward, the eighth cylinder 70 separates the hat ironing head 78 to the left and right, the hat ironing head 78 is divided into four parts to support the hat, and the hat ironing head 78 that is divided into four parts heats the hat to 100° C.-120° C. to perform ironing on the hat. Compared with an integrated hat ironing device D and a two-part hat ironing device D in the prior art, the hat supporting device G divides the hat ironing head 78 into four parts to support the hat and perform ironing on the hat, and a hat supporting effect is better. Moreover, the four parts of the hat ironing head 78 heat the hat separately, a hat ironing temperature is uniform, an ironing effect is also better, and shaping of the hat is convenient.

During feeding, at a feeding end of a rotating feeding machine, an automatic feeding machine grabs a brim of the hat and puts the hat to be ironed on the hat ironing head 78 from the front. Moreover, because a front end of the hat has the brim, a hat pulling head cannot be provided at the front end of the hat to press the front end of the hat as a left ironing mechanism. When the hat is not pressed, a certain impact will be caused to the ironing effect of the hat. Therefore, the feeding end of the hat is provided with the front hat pulling device B.

The front hat pulling device B is mounted on a side wall of the rack body 1, a bottom of the front hat pulling device B is provided with a front hat pulling device fixing column 6, one end of the front hat pulling device fixing column 6 is fixedly connected to the side wall of the rack body 1, another end is fixedly connected to a lower frame cross brace 7, two sides of the lower frame cross brace 7 are provided with frame stand braces 8, tops of the two frame stand braces 8 are provided with an upper frame cross brace 15, and the lower frame cross brace 7, the frame stand braces 8 and the upper frame cross brace 15 form a square front hat pulling device fixing frame. The front hat pulling device fixing frame is provided with a sliding movement assembly, one sides of the frame stand braces 8 that are away from the rack body 1 are provided with two first linear guide rails 16, first sliding blocks 17 are mounted in the first linear guide rails 16, a transplanting plate 18 is fixedly connected to the two first sliding blocks 17, and the transplanting plate 18 is provided in parallel with the upper frame cross brace 15. On one side of the transplanting plate 18 that is away from the rack body 1, the center of the transplanting plate 18 is fixedly connected to a front hat pulling head fixing frame 19, a second cylinder 21 is fixedly connected to a second cylinder 21 fixing frame, a piston rod of the second cylinder 21 is provided toward the ground, the piston rod of the second cylinder 21 is fixedly connected to a third cylinder fixing plate 22, a third cylinder 23 is mounted on a bottom surface of the three cylinder fixing plate 22, and a piston rod of the third cylinder 23 is provided toward the rack body 1. The piston rod of the third cylinder 23 is provided with a front hat pulling head fixing block 24, a front hat pulling head fixing shaft 25 is clamped in the front hat pulling head fixing block 24, and a front hat pulling head 26 is fixedly mounted at a bottom of the front hat pulling head fixing shaft 25. On one side of the transplanting plate 18 that is close to the rack body 1, two ends of the transplanting plate 18 are provided with two upright plates 14; on one sides of the frame stand braces 8 that are close to the rack body 1, first cylinder fixing frames 10 are fixedly mounted; two first cylinders 9 are mounted in the first cylinder fixing frames 10 respectively; and piston rods of the first cylinders 9 are provided toward the upper frame cross brace 15. Terminal ends of the piston rods of the first cylinders 9 are provided with first joint bearings 12, the first joint bearings 12 are connected to joint bearing fixing columns 13 that are fixedly mounted on the upright plates 14, and end portions of the joint bearing fixing columns 13 are provided with retaining rings 11 to prevent the first joint bearings 12 from sliding out from the joint bearing fixing columns 13. During use, the piston rods of the first cylinders 9 contract to make the front hat pulling head 26 descend to the front of the hat ironing head 78, the piston rod of the third cylinder 23 extends to make the front hat pulling head 26 attached to a front surface of the hat, the piston rod of the second cylinder 21 extends to make the front hat pulling device B pull the hat downward so as to ensure that the hat is in full contact with the hat ironing head 78 to realize shaping of the hat, and the hat is ironed through the hat ironing head 78. Moreover, because the front hat pulling device B fixes the hat from top to bottom, interference caused by fixing the brim of the hat is solved.

The automatic air blowing device C is mounted in the center of the turntable device E, and the automatic air blowing device C blows air to an upper portion of the hat being heated. As a preferred embodiment of the present invention, the automatic air blowing device C is fixedly mounted in the center of the cam splitter 81 and does not rotate with the turntable 80. In addition, the automatic air blowing device C can also be mounted at other positions, such as an edge of the rack A. A cooling device comprises a fixed base 27 that is mounted on the cam splitter 81, an air blowing device fixing frame 30 is mounted on the fixed base 27, the air blowing device fixing frame 30 is mounted on a fixed vertical plate, the air blowing device fixing frame 30 is in an inverted L shape, a top of the blowing device fixing frame 30 is provided with a fourth cylinder 31, a piston rod of the fourth cylinder 31 is provided toward the front hat pulling device B, the piston rod of the fourth cylinder 31 is fixedly connected to an air blowing nozzle fixing frame 32, and an air blowing nozzle 34 is vertically mounted in the air blowing nozzle fixing frame 32 and blows air downward from the upper portion of the hat by rotation. When the automatic air blowing device C is used, the piston rod drives the air blowing nozzle 34 to move forward to a top of the hat ironing device D at the feeding end, the air blowing nozzle 34 rotates and blows air to the hat to blow away water vapor so as to prevent excess vapor from adhering to the hat and affecting a shaping effect of the hat and to promote cooling and shaping of the hat, thereby improving the shaping effect of the hat.

During use, the hat to be ironed is placed at the feeding end, the piston rods of the first cylinders 9 contract to make the front hat pulling device B descend, the piston rod of the sixth cylinder 46 in the hat ironing device D contracts to make the rear hat pulling head 55, the left hat pulling head 53 and the right hat pulling head 54 contract inward to press a left side, a right side and a rear side of the hat, the piston rod of the third cylinder 23 extends to make the front hat pulling device B press the front of the hat, then the piston rods of the second cylinder 21 and the fifth cylinder 35 contract downward, the four hat pulling heads pull the cap downward to make the hat in full contact with the hat ironing head 78, then the piston rod of the seventh cylinder 60 extends, the piston rod of the eighth cylinder 70 contracts to divide the hat ironing head 78 into four parts for supporting the hat and heating and ironing the hat, and the hat is ironed at a temperature of 100° C.-120° C. for several seconds. During the ironing, the fourth cylinder 31 in the automatic air blowing device C extends and is located above the hat ironing head 78 to cool the hat and facilitate the shaping of the hat. After the ironing is completed, a front hat pressing head is retracted and raised, the rear hat pulling head 55, the left hat pulling head 53 and the right hat pulling head 54 remain in a pressed state, the cam splitter 81 controls the hat ironing device D to rotate, a next hat to be ironed is placed on the hat ironing head, and the steps are repeated. In a rotation process of the hat, the hat is subjected to heat preservation through the hat ironing head, raised and opened by the rear hat pulling head 55, the left hat pulling head 53 and the right hat pulling head 54 after being rotated to a discharging end, and the ironed hat is removed to realize cyclic hat feeding, shaping, hat ironing and hat removing, so as to realize automatic production of hats.

The above descriptions are only preferred embodiments of the present invention and technical principles used. Persons skilled in the art will understand that the present invention is not limited to the specific embodiments described herein. For persons skilled in the art, various obvious changes, readjustments, mutual combinations and substitutions can be made without departing from the scope of protection of the present invention. Therefore, although the present invention has been described in detail through the above embodiments, the present invention is not limited to the above embodiments and can also include more other equivalent embodiments without departing from the concept of the present invention, and the scope of the present invention is determined by the scope of the appended claims.

What is claimed is:

1. A multi-station rotating hat ironing machine for hat making industry, wherein the multi-station rotating hat ironing machine comprises: a rack;

a turntable device, wherein the turntable device is provided on the rack and comprises a turntable and a driving assembly that is provided at a bottom of the turntable;

hat ironing devices, wherein a plurality of hat ironing devices are mounted on the turntable device, the hat ironing devices each comprise a hat supporting device and a hat pulling device, the hat supporting device has a hat ironing head that can be divided into four parts, a bottom of the hat ironing head is provided with a transverse movement assembly for transversely separating and moving left and right parts and a longitudinal movement assembly for separating front and rear parts of the hat ironing head, and the hat pulling device is provided on an outer side of the hat supporting device; and an automatic air blowing device, wherein the automatic air blowing device is provided with an air blowing nozzle.

2. The multi-station rotating hat ironing machine for hat making industry according to claim 1, wherein one side of the rack is provided with a front hat pulling device, and the front hat pulling device comprises a front hat pulling device fixing frame, a sliding movement assembly that is hoisted in the front hat pulling device fixing frame and a front hat pulling head that is mounted at a bottom of the sliding movement assembly.

3. The multi-station rotating hat ironing machine for hat making industry according to claim 2, wherein the sliding movement assembly comprises first cylinders for longitudinally moving the front hat pulling head to an equal height of the hat ironing head, a third cylinder for pressing the front hat pulling head to a front of a hat and a second cylinder for pulling the hat downward, the front hat pulling device fixing frame is provided with two first linear guide rails, first sliding blocks are mounted in the first linear guide rails, a transplanting plate is fixedly connected to the two first sliding blocks, the first cylinders are provided on the front hat pulling device fixing frame, piston rods of the first cylinders are fixedly connected to the transplanting plate, the second cylinder is mounted on the transplanting plate, and a piston rod of the second cylinder is connected to a cylinder body of the third cylinder.

4. The multi-station rotating hat ironing machine for hat making industry according to claim 1, wherein the hat pulling device is mounted at the bottom of the turntable and comprises a plurality of pressing mechanisms and a downward pulling mechanism that is provided at bottoms of the pressing mechanisms.

5. The multi-station rotating hat ironing machine for hat making industry according to claim 4, wherein the downward pulling mechanism comprises a vertical moving plate on which the plurality of pressing mechanisms and a fifth cylinder are mounted, and a piston of the fifth cylinder is fixedly connected to a bottom of the vertical moving plate; and the pressing mechanisms each comprise a fixed column, a first rocker arm fixing plate and a second rocker arm fixing plate are fixedly mounted on two sides of the fixed column, an end portion of a cylinder body of a sixth cylinder is connected to the first rocker arm fixing plate through a cylinder fixing shaft, upper ends of the first rocker arm fixing plate and the second rocker arm fixing plate are provided with deep groove ball bearings, one end of a rocker arm is rotatably connected into the deep groove ball bearings, a piston rod of the sixth cylinder is connected to a second joint bearing, the second joint bearing is rotatably connected to a T-shaped clamp, the T-shaped clamp is fixedly mounted on a side wall of the rocker arm, a connection position of the T-shaped clamp tilts upward, an upper end of the rocker arm is provided with an adjustment rod, and an end portion of the adjustment rod is provided with a hat pulling head.

6. The multi-station rotating hat ironing machine for hat making industry according to claim 1, wherein the longitudinal movement assembly is mounted on a hat supporting device fixing bottom plate and comprises a seventh cylinder, second linear guide rails and second sliding blocks that are provided in the second linear guide rails, and a piston rod of the seventh cylinder is connected to longitudinal moving plate fixing seats;

the transverse movement assembly is provided on the longitudinal movement assembly and comprises a longitudinal moving plate that is mounted on the longitudinal moving plate fixing seats and the second sliding blocks, a slide rail fixing frame is provided above a cylinder body of the seventh cylinder, third linear guide rails are provided in the longitudinal moving plate and the slide rail fixing frame, third sliding blocks are provided in the slide rail fixing frame, and a piston rod of an eighth cylinder is connected to the third sliding blocks; and tops of the third sliding blocks are fixedly connected to a transverse movable plate.

7. The multi-station rotating hat ironing machine for hat making industry according to claim 6, wherein a front end of the piston rod of the seventh cylinder is provided with a first hydraulic buffer, and a buffer end of the first hydraulic buffer is in contact with a side wall of the longitudinal moving plate; and a second hydraulic buffer is provided above the eighth cylinder, and a buffer end of the second hydraulic buffer is in contact with a positioning block that is connected to a side wall of the transverse movable plate.

8. The multi-station rotating hat ironing machine for hat making industry according to claim 1, wherein the rack is designed in two layers, an upper layer of the rack is provided with a circular through hole, a plurality of wave bead buffers are provided at equal intervals around the circular through hole, and wave beads in the wave bead buffers are in contact with a bottom surface of the turntable device; and a lower layer of the rack is provided with a servo motor fixing seat and a cam splitter fixing frame.

9. The multi-station rotating hat ironing machine for hat making industry according to claim 8, wherein the driving assembly comprises a servo motor that is mounted on the servo motor fixing seat and a cam splitter that is mounted in the cam splitter fixing frame, an output shaft of the servo motor is provided with a driving synchronous pulley, an input shaft of the cam splitter is provided with a driven synchronous pulley, and the driving synchronous pulley is connected to the driven synchronous pulley through a synchronous belt.

10. The multi-station rotating hat ironing machine for hat making industry according to claim 9, wherein the automatic air blowing device is fixedly mounted in a center of the cam splitter and provided toward a feeding end and comprises an air blowing device fixing frame, a fourth cylinder and the air blowing nozzle, the fourth cylinder is provided on a top of the air blowing device fixing frame, and the air blowing nozzle is connected to a piston rod of the fourth cylinder.

* * * * *